US005291004A

United States Patent [19]

Frank et al.

[11] Patent Number: 5,291,004

[45] Date of Patent: Mar. 1, 1994

[54] CARD-CONTROLLED BEVERAGE DISTRIBUTION SYSTEM

[75] Inventors: Michael S. Frank, 414 S. Craig St., Suite 283, Pittsburgh, Pa. 15213; R. Patrick Garrett, Pittsburgh, Pa.

[73] Assignee: Michael S. Frank, Pittsburgh, Pa.

[21] Appl. No.: 900,548

[22] Filed: Jun. 18, 1992

Related U.S. Application Data

[63] Continuation of Ser. No. 646,158, Jan. 25, 1991, abandoned.

[51] Int. Cl.[5] ..... G07F 15/02; G07F 7/08

[52] U.S. Cl. ..... 235/381; 222/2; 62/393

[58] Field of Search ..... 222/2, 71; 235/380, 235/381, 382, 382.5, 487, 385, 383; 4/420.2; 62/393, 436

[56] References Cited

U.S. PATENT DOCUMENTS

| | | | |
|---|---|---|---|
| 3,632,988 | 1/1972 | Yamawaki | 235/381 |
| 3,695,314 | 10/1972 | Watts et al. | 222/2 |
| 3,786,421 | 1/1974 | Wostl et al. | 235/381 |
| 3,891,830 | 6/1975 | Goldman | 222/2 |
| 4,395,626 | 7/1983 | Barker et al. | 235/381 |
| 4,628,974 | 12/1986 | Meyer | 222/129.4 |
| 4,653,126 | 3/1987 | Morandi et al. | 4/420.2 |
| 4,731,575 | 3/1988 | Sloan | 324/113 |
| 4,778,983 | 10/1988 | Ushikubo | 235/381 |
| 4,891,503 | 1/1990 | Jewell | 235/380 |
| 4,967,366 | 10/1990 | Kaehler | 235/381 |
| 5,007,560 | 4/1991 | Sassak | 222/2 |
| 5,094,088 | 3/1992 | Davis | 62/393 |

FOREIGN PATENT DOCUMENTS

| | | | |
|---|---|---|---|
| 0272245 | 6/1988 | European Pat. Off. | 235/381 |
| 81/02940 | 10/1981 | PCT Int'l Appl. | 235/381 |

*Primary Examiner*—Samuel A. Turner
*Assistant Examiner*—Edward H. Sikorski
*Attorney, Agent, or Firm*—Ansel M. Schwartz

[57] ABSTRACT

A self-service beverage distribution system includes a piping network with refrigerated tubing for transporting beverages, such as beer, from at least one source to at least one output. A drinker purchases a magnetic card which represents a predetermined quantity of beer, and which specifies which beer sources the drinker can have access to. A flow meter measures how much beer the drinker dispenses, and the quantity of beer represented on the card is decreased accordingly.

2 Claims, 4 Drawing Sheets

CARD-CONTROLLED BEVERAGE DISTRIBUTION SYSTEM

This is a continuation of copending application(s) Ser. No. 07/646,158 filed on Jan. 25, 1991 now abandoned.

FIELD OF THE INVENTION

The present invention pertains to beverage distribution. More specifically, the present invention pertains to a beverage distribution apparatus which is controlled by an external information storage device.

BACKGROUND OF THE INVENTION

The ingestion of alcohol has been a favorite pastime of America since our founding fathers floated over from Europe. Back then, it was well documented that our newly founded liberty did not mix well with our drinks. Alcohol's temporary effects of physical and mental impairment was surely the source of many altercations during our colonial period. One of the first laws was against drinking alcohol on church day. (Then, as is now, this day is Sunday).

Since then, the governmental control of alcohol distribution has expanded. Many laws have been passed, and revoked as in prohibition. The existing laws attempt to define the responsibility of a person who serves alcoholic beverages . . . such as a bartender. These laws have held that the server is responsible for the actions of the drinker. This implies that the server must monitor the state of the drinker, from his age at the door to his ability to balance on a bar stool.

As these are the laws, alcohol servers have established their own guidelines to prevent individuals from drinking more than they can handle. The server is forced to define an acceptable volume of alcohol per person, and then implement a system which ensures no more than this volume is delivered to the drinker. In this manner, liability is reduced by sacrificing personal judgement for rules. This is typically the unhearty job of the bartender.

Unfortunately, this monitoring system is detrimental to the drinker. Not only is he forced to drink by someone elses guidelines, he must often endure crowded areas around a bar, long waits and warm beer. Our bar bound ancestors would heartily disapprove.

The responsibility of the server is an issue which will, no doubt, be long debated in our court system. The following invention allows the server to separate the duties of beer distribution and liability by automating the beer distribution process. Beer drinking has entered the modern age.

SUMMARY OF THE INVENTION

The present invention is an apparatus for dispensing of beverages. The apparatus includes a piping network for transporting a beverage from at least one source to at least one output. The source is at a first location while the output is at a second location which is remote from the first location. The distributing apparatus also has a device for actuating the flow of the beverage from a source to an output and a device for controlling the actuating device. The controlling device has at least one information storage device having information thereon and a first element for reading the information and generating a first signal corresponding to the information. The actuating device is responsive to the first signal. Preferably, the controlling device includes a second element for measuring the flow of the beverage from the output and generating a second signal indicative of the flow and a third controlling element which generates a third signal depending on the first and second signals. The third signal controls the actuating means. The distributing device also includes a device for controlling the temperature of the piping network. The temperature controlling device is disposed in thermal communication with the positioned about the piping network along a majority of its length and preferably includes refrigerated tubing.

The present invention is also a method of dispensing a beverage, such as beer which includes the step of reading information from an information storage device of a user with a computer at a first location. Next, there is the step of providing the user access to the beverage at the first location through a piping network fluidically connected at a beverage source at a second location depending on the information and controlling the temperature of the piping network. When the beverage is beer, the piping network is cooled so that the beer is not warmed.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
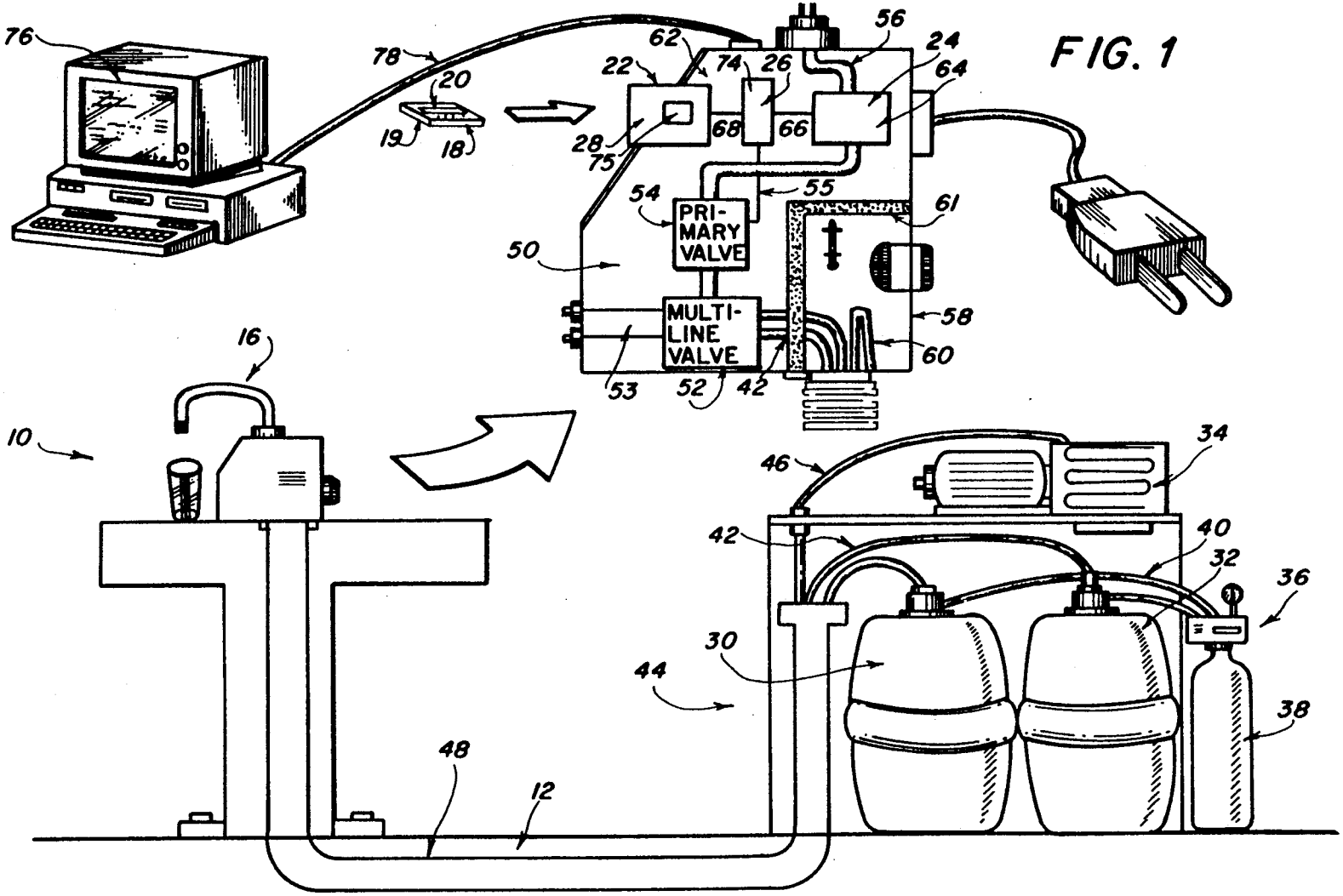
FIG. 1 is a schematic representation of the fluid distribution apparatus with a single outlet.

Referring now to the drawings wherein like reference numerals refer to similar or identical parts throughout the several views, and more specifically to FIG. 1 thereof, there is shown an apparatus 10 for distributing fluid. The apparatus 10 is comprised of a piping network 12 for transporting fluid from at least one source 14 to at least one output 16 and means for actuating the flow of fluid from the source 14 to the output 16. The apparatus 10 is additionally comprised of means for controlling the actuating means. The controlling means has at least one information storage device 18 which stores information 20, a first element 22 for accepting the information storage device 18 which changes states depending on information 20, a second element 24 having states depending on the flow rate of the fluid from the output, and a third element 26 having states depending on the state of the first element 22 and the state of the second element 24. The state of the third element controls the actuating means. The first element 22 changes states depending on the information 20 of the information storage device 18. A state can represent, for example, on or off, or correspond to the given flow of fluid.

In one preferred embodiment, the information 20 is magnetically stored on the information storage device 18 which includes a card 19. In this case, the first element 22 includes a magnetic card reader 28. Preferably, the fluid is a beverage such as beer 30 which is stored in a source 14 which includes a plurality of kegs 32. The kegs 32 are preferably stored in a refrigerator 34 for maintaining a chilled temperature. A pressure source 36 is provided for pressurizing the kegs 32. The pressure source 36 is preferably comprised of a gas cylinder 38 and gas lines 40 for fluidically connecting the cylinder 38 to the kegs 32.

Figure 2:
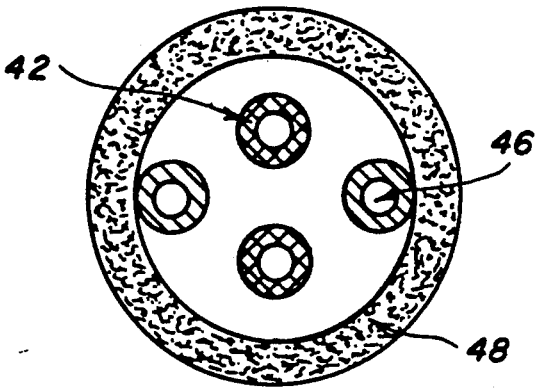
FIG. 2 is a cross section showing the interior of the insulative tubing.

The piping network 12 is further comprised of fluid lines 42 for fluidically connecting the kegs 32 to the actuating means and means for controlling the temperature of the beer 30 as it is transported from the source 14 to the output 16. In a preferred embodiment, the temperature controlling means is comprised of a refrigerated line 46 and insulative tubing 48, as shown in FIG. 2. The fluid lines 42 and the refrigerated line 46 are disposed within the tubing 48. The refrigerated line 46 is designed to chill the air in the tubing and around the fluid lines 42. In this manner, the beer 30 in the fluid lines 42 can travel many feet from the source 14 without becoming warm while maintaining a constant chilled temperature.

Figure 3:
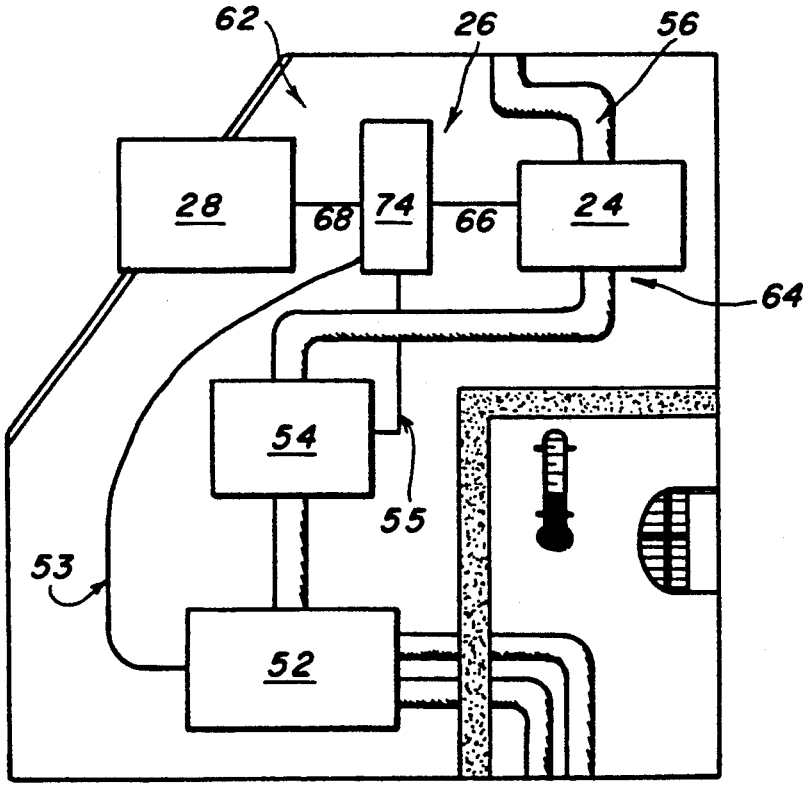
FIG. 3 shows the output wherein the multiple line valve is controlled by the controller.

The fluid lines 42 originate from the kegs 32 and are fluidically connected to the actuating means. The actuating means is preferably comprised of a valve system 50 for fluidically connecting only one of the fluid lines to the output. In a preferred embodiment, the valve system 50 includes a multiple line valve 52 and a primary valve 54. The multiple line valve 52 serves the function of fluidically connecting only one of the fluid lines 42 from the kegs 32 to the primary valve 54. The primary valve 54 fluidically switches the output line 56 of the multiple line valve 52, to the output 16. Preferably, the state of the multiple line valve 52 is controlled from a signal supplied through a multiple valve bus 53. The signal can be generated either manually with a push button switch, as shown in FIG. 1. Alternatively, the signal can be generated by the first element 22 depending on the information 20. In this case, the multiple line valve 52 communicates with the first element through the multiple valve bus 53 as shown in FIG. 3.

As shown in FIG. 1, a portion of the fluid lines 42, and the actuating means are disposed within a control console 58. Preferably, the control console 58 includes an insulated section 60 defined by insulation 61. This insulated section 60 serves as a thermal barrier between the refrigerated line 46 and the control section 62 of the console. Preferably, the magnetic card reader 28, the second element 22 and the third element 24 are also disposed within the control console 58. The second element is preferably comprised of a flow meter 64. Preferably, the flow meter 64 measures the flow rate of the beer 30 and generates an electrical pulse for each predetermined volume of beer. A flow meter bus 66 feeds the pulses into the third element 24 of the control means.

Figure 4:
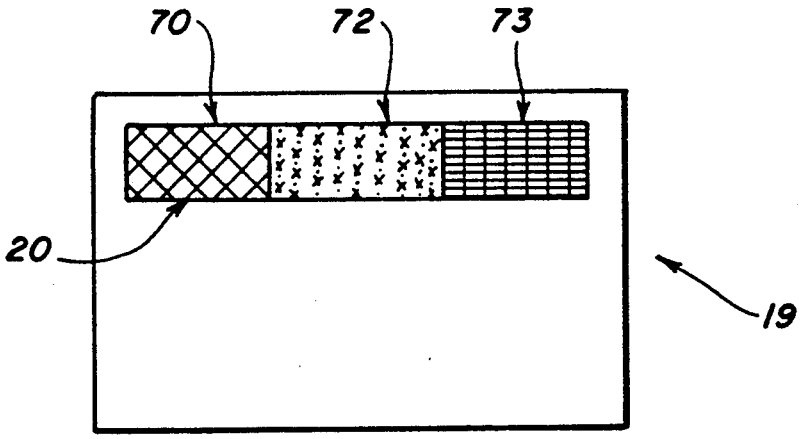
FIG. 4 shows the magnetic card.

As stated earlier, the first element 22 is preferably a magnetic card reader 28 that translates the information 20 stored magnetically on the card 19 into the appropriate electric signals. These electric signals travel to the third element 26 through the card reader bus 68. As shown in FIG. 4, the information 20 preferably comprises a first portion 70 serving to identify the card and a second portion 72 representing a predetermined quantity of the fluid, in this embodiment, beer 30. The magnetic card reader 28 reads both the first portion 70 and the second portion 72 and translates this information to the appropriate electrical signals which are sent to the third element via the card reader bus 68.

The magnetic card reader preferably comprises means 75 to change the information 20 on the card 18. In this manner, the quantity of beer represented by the second portion 72 can be decreased as the beer is distributed. The information changing means 75 also can add beers to the card when the drinker pays for more beer 30. Preferably, the information changing means 75 is primarily controlled by the flow meter 64 which generates the appropriate signals which are sent on the card reader bus 68 and into the magnetic card reader 28.

Preferably, the third element comprises a controller 74 which serves to control and sense the functions of the magnetic card reader 28, the flow meter 64, the primary valve 54 and the multiple line valve 52. In one preferred embodiment, the controller 74 receives a second signal from the flow meter 64 and a first signal from the magnetic card reader 28 via flow meter bus 66 and card reader bus 68, respectively. The controller 74 interprets these input signals and generates appropriate output signals such as a third signal which control the multiple line valve 52, the primary valve 54 and the information changing means of the magnetic card reader. These output signals are communicated via the multiple line valve bus 53, primary valve bus 55 and the card reader bus 58.

As shown in FIG. 3, the information 20 alternatively includes a third portion 73 for controlling the valve system 50. This will ensure that only the appropriate fluid lines 42 can be accessed by a specific card. In this manner, the user can obtain beer depending on the card purchased.

Preferably, the controller 74 is interfaced with a computer 76 which communicates with the controller 74 through computer bus 78. In this manner, the state of the controller 74 can be read and influenced.

Figure 5:
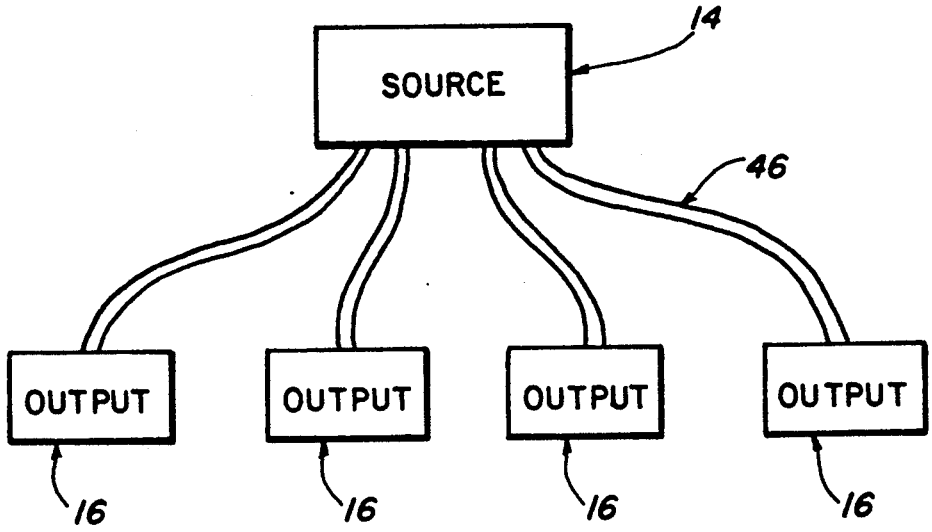
FIG. 5 shows a plurality of outputs connected to the source.
Figure 6:
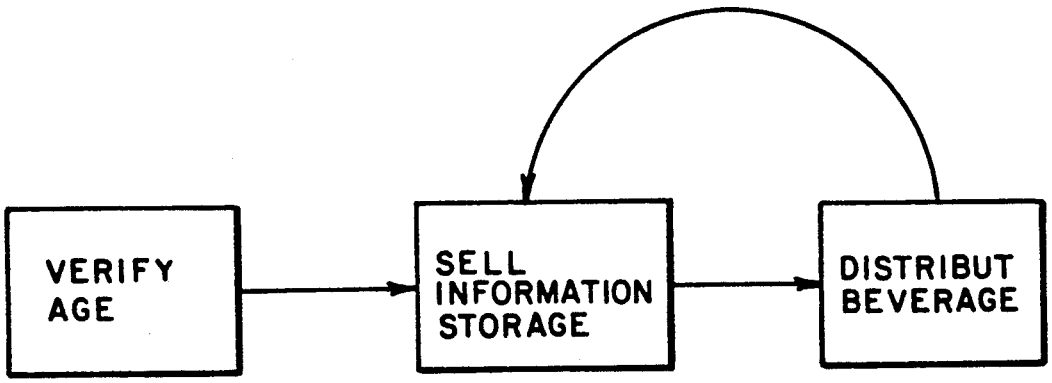
FIG. 6 shows a flow chart representing the steps in a preferred method of operation.

In another preferred embodiment, and as shown in FIG. 5, there are a plurality of outputs 16 originating from a common source 18. In this manner, the source 14 can service a plurality of drinkers.

In the operation of the preferred embodiment, a drinker who wishes to participate on the fluid distribution apparatus 10 obtains a card 18 having a predetermined amount of beers thereon. The drinker then proceeds to a convenient output 16 and inserts the card 18 into the magnetic card reader. The magnetic card reader 28 reads the card, specifically, the first portion 70 and the second portion 72. The signals generated by the card reader 28 are sent to the controller 74. The controller 74 first determines if the information 20 represented by the first portion 70 is valid identification. If so, the controller 74 then interprets the signals generated by the second portion 72 of information. If the amount of beer 30 is greater than zero, then the controller 74 generates a signal that is sent to the primary valve 54 via the primary valve bus 55. This signal opens and closes the primary valve 54 which in turn allows beer 30 flow to the output. To choose which keg 32 is connected to the output 16, the drinker generates a signal via the multiple line valve bus 53. This signal controls the state of the multiple line valve 54 thereby fluidically connecting the user's choice of keg 32 to the output 16. The beer 30 will be fluidically connected to the output 16 when the primary valve 54 is open.

The drinker can now operate his tap to dispense a variable amount of cold beer. Once flow starts the flow meter 64 generates a pulse for a predetermined quantity of liquid. This pulse is sent to the controller via flow meter bus 66. The controller 74 translates this pulse into a signal which controls the information altering means 75. The information altering means 75 changes the second portion 72 of information 20 in relationship to the amount of beer 30 that flowed past the flow meter 64. For example, if a pulse represents one ounce of beer, then the information altering means will subtract one ounce of beer from the second portion of information 20. Since the second portion 72 of information 20 has now been changed, the controller 74 will essentially re-evaluate the signal to determine if the second portion represents at least one ounce of beer. If the signal does represent one ounce of beer, then another ounce can be distributed: Note, there is no change of state of the primary valve 54 if the second portion 72 of information 20 represents more than one beer. In this manner, the drinker can pour beer from the tap until the information altering means counts the second portion 72 down to zero. The drinker is then out of beer.

In a preferred method of operation, the fluid distribution apparatus 10 can be used to allow personal dispensing of alcoholic beverages such as beer. The method comprises the following steps. Verifying the age of the user who would like to participate on the fluid distribution apparatus 10. Then, selling the card 18 to the user for accessing the fluid distribution apparatus 10 if the user is of the proper drinking age and distributing the beverage to the user depending on the information 20. Preferably, before the selling step, a step for determining the condition of the user, is provided. This determining step can be carried out in numerous ways. Preferably, the determining step includes the step of subjecting the drinker to a breath analysis for determining the amount of alcohol within the user's bloodstream. In this manner, the liability of those involved in selling the alcoholic beverages is reduced by separating the duties of beer dispensing from baby-sitting. To keep an accurate record of the information 20 on the card, the step of duplicating the information 20 for accurate record keeping is provided. This step preferably includes the step of transferring the duplicated information to the computer 26 for storage and further manipulation. This allows those involved in selling the beer to keep an accurate record of how much beer was provided for each card 18. Coupled with the proper rules, these steps can significantly reduce the liability of those selling alcoholic beverages.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A beverage distribution apparatus comprising:

a piping network for transporting a beverage from at least one source at a first location to at least one output at a second location, said second location remote from said first location;

means for actuating the flow of beverage from a source at the first location to an output at the second location, said actuating means comprising a valve system for fluidically connecting an output to a desired source, said actuating means in communication with the piping network;

means for controlling the actuating means, said controlling means comprising at least one card having information thereon, said information comprising a first portion serving to identify the card, a second portion representing a predetermined quantity of beverage, and a third portion for specifying which sources the user can have access to, said controlling means comprising a card reader for reading the information from the card and generating a first signal corresponding to the information, a flow meter for measuring the flow of the beverage from the output and generating a second signal indicative of the flow, and an element for generating a third signal depending on said first and second signals, said third signal controlling said actuating means, said element in communication with the card reader and the flow meter, said means for controlling the actuating means in communication with the actuating means; and means for controlling the temperature of the piping network, said temperature controlling means disposed in thermal communication with and positioned about said piping network along a majority of its length.

2. An apparatus as described in claim 1 wherein the beverage is beer.

* * * * *